United States Patent [19]

Eriksson

[11] Patent Number: 4,852,622

[45] Date of Patent: Aug. 1, 1989

[54] DEBARKING MEANS FOR ROTATION RING TYPE BARKING MACHINES

[75] Inventor: Bror Eriksson, Iggesund, Sweden

[73] Assignee: Iggesund Tools AB, Iggesund, Sweden

[21] Appl. No.: 274,835

[22] Filed: Nov. 22, 1988

[30] Foreign Application Priority Data

Dec. 1, 1987 [SE] Sweden ..... 8704786

[51] Int. Cl.[4] ..... B27L 1/00; B27G 13/00

[52] U.S. Cl. ..... 144/208 E; 144/241; 407/48; 407/103

[58] Field of Search ..... 407/103, 48, 49, 51; 144/208 R, 208 E, 241

[56] References Cited

U.S. PATENT DOCUMENTS

| | | | |
|---|---|---|---|
| 2,880,771 | 4/1959 | Annis, Jr. . | |
| 3,026,919 | 3/1962 | Lunn | 144/208 E |
| 3,189,067 | 6/1965 | Dilligham . | |
| 4,011,049 | 3/1977 | McCreery | 407/103 |
| 4,209,047 | 6/1980 | Weill | 144/241 |
| 4,280,541 | 7/1981 | Reimler et al. | 144/241 |
| 4,368,764 | 1/1983 | Peterson et al. . | |
| 4,456,409 | 6/1984 | Burmeister | 407/48 |
| 4,653,559 | 3/1987 | Ackerman | 144/241 |

FOREIGN PATENT DOCUMENTS

| | | | |
|---|---|---|---|
| 551454 | 3/1956 | Canada | 144/241 |
| 77128023 | 5/1979 | Sweden . | |

OTHER PUBLICATIONS

Pct International Type Search Report Mailed 1988-0-6-03.

*Primary Examiner*—W. Donald Bray

*Attorney, Agent, or Firm*—McFadden, Fincham, Marcus & Allen

[57] ABSTRACT

The invention relates to a debarking means for rotation ring type barking machines, and of the type comprising a plurality of swinging arms (1) yieldably engaging the circumference of an unbarked log and each formed at its free end with a seat (4) for a debarking means (2) detachably mounted by means of a bolt connection (3). The debarking means has a leading edge (7) serving as a cutting edge and a trailing support edge or surface (8) adapted to engage a shoulder (5) on the seat (4) to prevent turning of said debarking means relative to the arm. The support edge (8) extends obliquely in relation to the cutting edge (7), more particularly along the entire width of the debarking means and between two side edges of said means which are of different length.

12 Claims, 4 Drawing Sheets

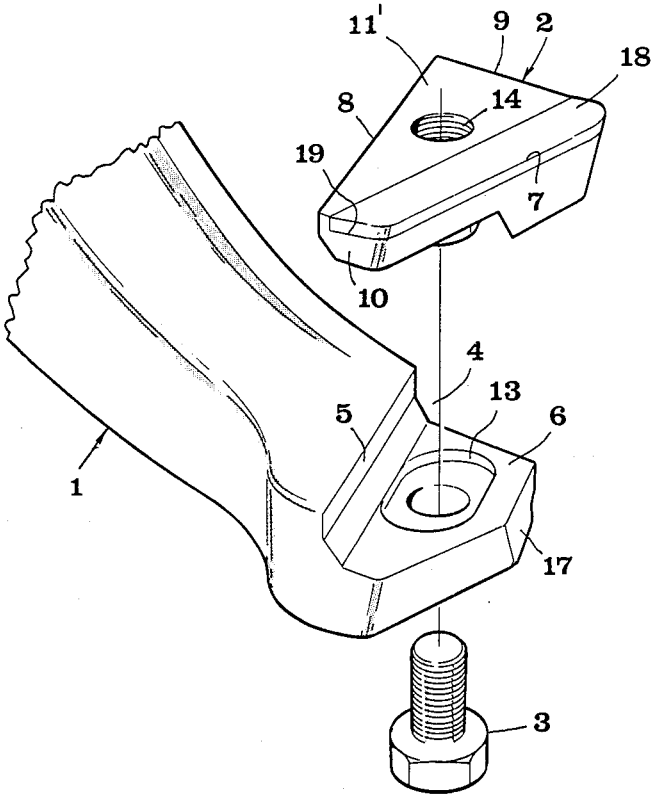
Fig 1
Fig 2
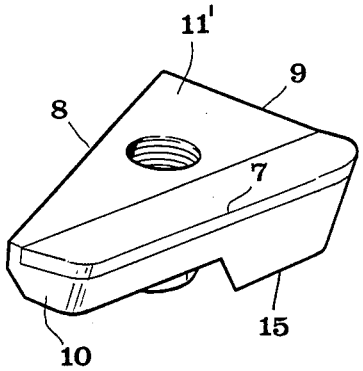
Fig 3
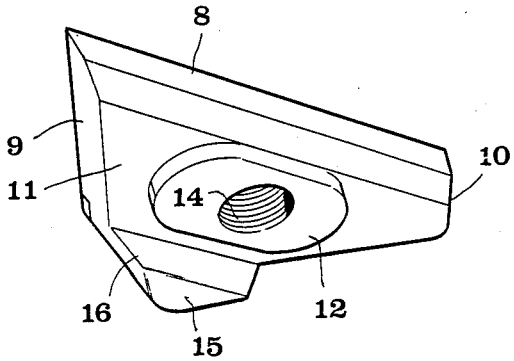

Fig 11
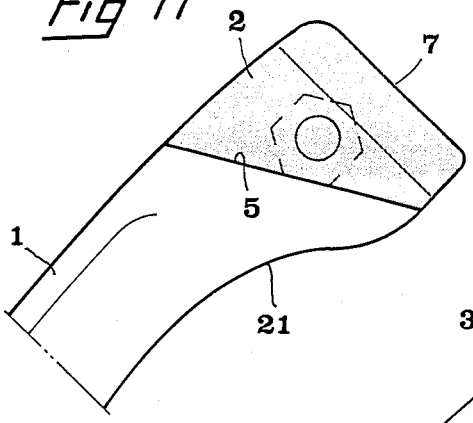
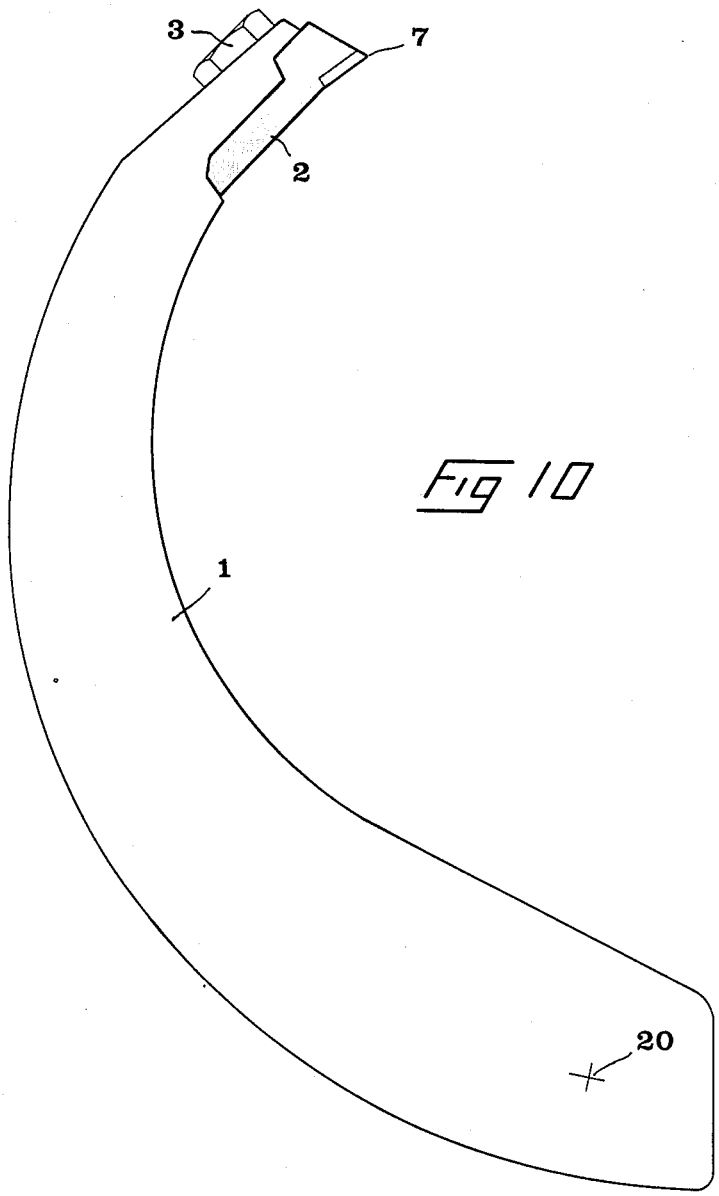
Fig 10

DEBARKING MEANS FOR ROTATION RING TYPE BARKING MACHINES

TECHNICAL FIELD OF THE INVENTION

The invention relates to a debarking means for rotation ring type barking machines, and of the type comprising a plurality of swinging arms yieldably engaging the circumference of an unbarked log and each formed at its free end with a seat for a debarking means detachably mounted by means of a bolt connection and having a leading edge serving as a cutting edge, a trailing support edge or surface adapted to engage a shoulder on the seat to prevent turning of said debarking means relative to the arm, and two side edges extending between said leading and trailing edges.

Barking machines of the above-mentioned type basically operate in such a manner that the individual log is fed lengthwise through the hollow space of a rotor on the inside of which the swinging arms are hingedly mounted, at the same time as the rotor is caused to rotate, the arms and the debarking means thereon being yieldably urged against the circumference of the log by means of suitable spring means enabling the debarking means to follow any irregularities of the log surface. During operation, the debarking means follow helical paths of motion along the log circumference and remove the bark down to the cambium layer thereof. To ensure complete removal of the bark, the rate at which the log is fed lengthwise through the rotor must not exceed a given rotational speed of the rotor since otherwise unworked bark portions would be left on the log. In other words, the maximum rotor speed determines the maximum rate at which the logs are fed lengthwise through the machine and thus the machine output.

BACKGROUND OF THE INVENTION

A variety of different types of detachable debarking means have previously been developed for the barking machines referred to above. See for example Swedish patent specification 7712802-3 (Publ. No. 430,931) and U.S. Pat. Nos. 2,880,771, 3,189,067 and 4,209,047.

A feature common to prior art debarking means of the detachable type is that they have generally been in the form of an essentially square or otherwise equilateral plate or plate-like body which in itself has no little mass and, furthermore, must be firmly and reliably attached to securely hold the plate in the seat without any tendency to dislodge itself. To achieve such a strong attachment, the bolt and washer of the bolt connection must be made fairly heavy, and also the parts of the swinging arm defining the seat must be strongly dimensioned. These circumstances in combination imply that a considerable mass is applied to the free end of the swinging arm, and this in turn means a restriction of the possibilities of increasing the rotor speed since the centrifugal force generated upon rotation of the rotor always strives to move the swinging arms out of engagement with the log against the action of the spring means by which the arms are held in engagement with the log. In view hereof, the slightest increase of the mass in the swinging arms, in particular the mass in the free arm ends farthest away from the pivot points, means that the rotor speed must be reduced correspondingly.

BRIEF DESCRIPTION OF THE INVENTIVE CONCEPT

The present invention aims at making it possible to increase the production output of rotation ring type barking machines, more particularly by providing a debarking means which requires but an absolute minimum of additional mass for the swinging arms and which therefore permits a marked increase of the rotor speed (and, consequently, an increase of the log feed rate). According to the principal features of the invention, this is achieved in that the two side edges are of different length, and that the trailing support edge or surface extends at an oblique or acute angle toward the leading cutting edge.

By obliquely positioning the support edge relative to the cutting edge, the former obtains, at a given width of the latter, a length which is markedly greater than if the edges were parallel to one another. The greater length of the support edge implies that the debarking means can be securely held in the seat, without it being necessary to increase the dimensions of the debarking means or the rest of the swinging arm.

In practice, the oblique angle between the support edge and the cutting edge can amount to 20°–40°, suitably 25°–35°, and preferably about 30°.

BRIEF DESCRIPTION OF THE ACCOMPANYING DRAWINGS

In the drawings

FIG. 1 is an exploded view showing part of a swinging arm, a debarking means according to the invention, and a bolt for attaching said means to the arm;

FIG. 2 is a perspective view as seen from above of the debarking means according to the invention;

FIG. 3 is a perspective view as seen from below of the same means;

FIG. 10 is a side view showing the said means mounted in a swinging arm;

FIG. 11 is a plan view showing the same means; and

DETAILED DESCRIPTION OF A PREFERRED EMBODIMENT OF THE INVENTION

Figure 5:
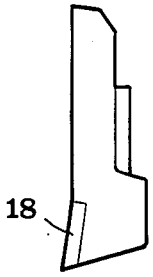
FIG. 5 is a side view of the means as seen from the left in FIG. 4.

Reference numeral 1 in FIG. 1 designates a swinging arm in a barking machine, reference numeral 2 designates a debarking means designed in accordance with the invention, and reference numeral 3 designates a bolt for attaching the said means to the swinging arm. The leading free end of the swinging arm 1 is formed with a seat 4 defined by a shoulder 5 and a bottom 6 whose plane is substantially perpendicular to the plane of the shoulder 5. The debarking means 2 has a leading edge 7 serving as a cutting edge, and a trailing support edge or surface 8 adapted to engage the shoulder 5 of the seat 4 on the swinging arm. According to the invention, the support edge or surface 8 extends obliquely to the cutting edge 7, more particularly along the entire width of the debarking means and between two side edges 9, 10 of said means which are of different length and essentially parallel to one other. In the embodiment illustrated, the oblique angle between the support edge 8 and the cutting edge 7 is about 30°, although in practice is may be either greater or smaller, for example 20°–40°, or suitably 25°–35°.

The planar lower side 11 of the means 2 is formed with a projection 12 adapted to snugly fit into a corresponding recess 13 in the seat bottom surface 6. The projection 12 is of oblong shape and is defined by two rectilinear mutually parallel long sides merging into semicircular end portions. The recess 13 has essentially the same shape and dimensions as the projection 12. Extending through the projection is a threaded hole 14 adapted to receive the attachment bolt 3, the head of which is tightened against the lower side of the leading end of the swinging arm 1.

Also projecting from the lower side 11 of the debarking means is a heel 15 having a vertical rear face 16 adapted to engage with a vertical front face 17 on the swinging arm.

The sharp cutting edge 7 is part of an elongate insert member 18 which is secured, for example by brazing, in a recess 19 of the debarking means 2 and which, in per se known manner, has a higher hardness and resistance to wear than the rest of said means. In practice, the insert part 18 may be made of hard alloy or STELLITE, the rest of the debarking means being made of steel, for example toughened steel which is precision-cast.

Figure 4:
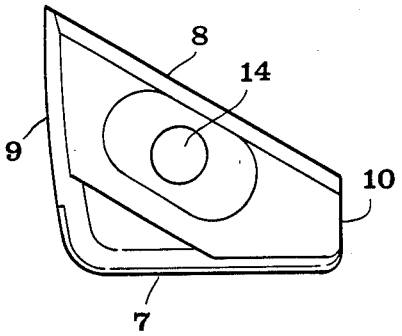
FIG. 4 is a plan view as seen from below of the said means.
Figure 7:
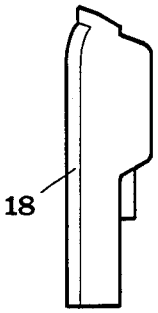
FIG. 7 is an end view as seen from in front.
Figure 6:
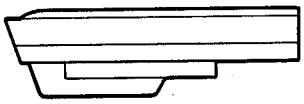
FIG. 6 is an end view as seen from the rear of the said means.
Figure 9:
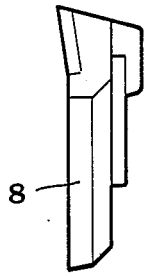
FIG. 9 is a side view of the said means as seen from the right in FIG. 8.
Figure 8:
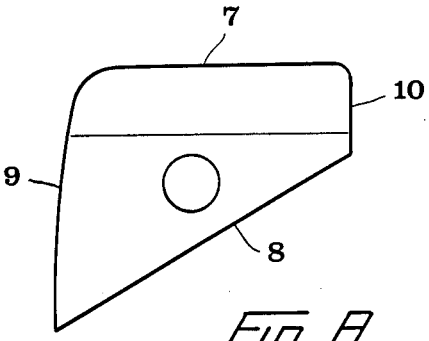
FIG. 8 is a plan view as seen from above.

As is best seen from FIGS. 4 and 8, the longer side edge 9 of the two side edges 9, 10 of the debarking means is slightly curved and is that part of the debarking means which is first struck by a log advancing toward the swinging arm and the debarking means. Because of its slightly curved shape, the edge surface 9 will not dig into the leading end of the log, but will release the log end fairly smoothly. It should here be pointed out that the large force to which the debarking means is subjected when struck by the log, will be distributed in an advantageous manner to the swinging arm by the oblique support surface 8 which will divide the force into a fairly large force component directed in the longitudinal direction of the arm and a smaller component perpendicular thereto.

FIGS. 10 and 11 illustrate how the cutting edge 7 of the debarking means extends substantially parallel to the geometrical axis 20 about which the arm 1 pivots. As will appear from FIG. 11, the width of the arm 1 has been reduced at 21 in the area behind the shoulder 5 to approximately half the width of the debarking means 2.

In practice, the debarking means according to the invention may have a width of about 50 mm (corresponding to the distance between the two mutually parallel side edges or surfaces 9, 10) so that the cutting edge 7 has a length of about 50 mm. If the oblique angle between the cutting edge 7 and the support surface 8 is about 30°, the length of the support surface will exceed 60 mm. At the same time, the length of the longer side edge 9 is about 50. mm, while the shorter side edge has a length of 15 mm. The thickness of the plate-shaped means, i.e. the distance between the lower side 11 and the upper side 11', may then be about 7 mm. Naturally, these dimensions may vary considerably, depending upon the size of the machine.

Figure 12:
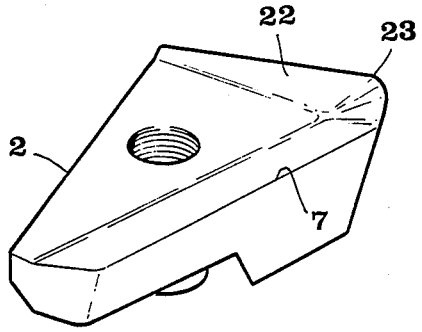
FIG. 12 is a perspective view showing an alternative embodiment of the said debarking means.

FIG. 12 shows an alternative embodiment in which the upper side of the debarking means is formed, in the area of the longer side edge 9, with a knife-like bead 22 which has a sharp edge 23 adapted to cut a helical notch in the bark of the log during barking, whereby the risk that the bark is detached from the log in the form of long strips—a risk which occurs especially during barking of trees felled in the spring—is effectively eliminated because the edge 23 cuts the bark into pieces of a length not exceeding the width of the debarking means.

The oblique position of the rear support surface of the debarking means provides, in combination with the oblong projection on the underside of said means and the heel at the leading end of said means, an exceedingly firm attachment of the debarking means, in spite of the fact that both the debarking means and the associated swinging arm have a relatively small mass. In this manner, the rotor speed can be increased without causing the swinging arms to disengage themselves from the log against the action of the spring means, and this in turn increases the production capacity of the barking machine.

I claim:

1. Debarking means for a rotation ring-type barking machine having a plurality of curved arms, wherein said debarking means comprises a leading edge forming a cutting edge; a trailing edge adapted to engage with a seat on a curved arm; a pair of side edges extending between opposite ends of said cutting edge and said trailing edge, said side edges being of different lengths thereby forming long and short side edges, said trailing edge extending at an acute angle to said leading edge; and means for detachable mounting said debarking means to a curved arm.

2. Debarking means as claimed in claim 1, wherein said trailing edge extends at an angle of between about 20° to 40° to said leading edge.

3. Debarking means as claimed in claim 2, wherein said angle is between about 25° and 35° to said leading edge.

4. Debarking means as claimed in claim 3, wherein said angle is about 35° to said leading edge.

5. Debarking means as claimed in claim 1, further including a rectangular projection on a bottom surface of said debarking means, adapted to fit in a recessed inset seat in an arm of said ring-type barking machine.

6. Debarking means as claimed in claim 1, wherein said long side edge has a convex arcuate form.

7. Debarking means as claimed in claim 1, wherein said long side edge forms a front edge for initial contact with a log, said long edge including a bead thereon, said bead having a sharp edge on a forward part thereof for cutting a helical notch in the bark of a log.

8. Debarking means as claimed in claim 5, wherein said long side edge forms a front edge for initial contact with a log, said long side edge including a bead thereon, said bead having a sharp edge on a forward part thereof for cutting a helical notch in the bark of a log.

9. Debarking means as claimed in claim 1, wherein said means for detachably mounting said debarking means to an arm comprises an aperture extending through said debarking means.

10. Debarking means as claimed in claim 9, wherein said aperture comprises a threaded hole.

11. Debarking means as claimed in claim 5, wherein said means for detachably mounting said debarking means to an arm comprises an aperture extending through said debarking means.

12. Debarking means as claimed in claim 11, wherein said aperture comprises a threaded hole.

* * * * *